US009297616B2

(12) United States Patent
Daniel et al.

(10) Patent No.: US 9,297,616 B2
(45) Date of Patent: Mar. 29, 2016

(54) SYSTEMS AND METHODS FOR ASSOCIATING AN ACCESSORY WITH A FIREARM

(75) Inventors: Marvin C. Daniel, Pooler, GA (US); Eric M. Rice, Northwood, OH (US)

(73) Assignee: DANIEL DEFENSE, INC., Black Creek, GA (US)

( * ) Notice: Subject to any disclaimer, the term of this patent is extended or adjusted under 35 U.S.C. 154(b) by 152 days.

(21) Appl. No.: 13/342,716

(22) Filed: Jan. 3, 2012

(65) Prior Publication Data

US 2012/0167438 A1 Jul. 5, 2012

Related U.S. Application Data

(60) Provisional application No. 61/428,981, filed on Dec. 31, 2010.

(51) Int. Cl.
*F41G 1/38* (2006.01)
*F41G 11/00* (2006.01)

(52) U.S. Cl.
CPC ..... *F41G 11/004* (2013.01); *Y10T 29/49959* (2015.01)

(58) Field of Classification Search
CPC ..... F41G 11/004
USPC ..... 42/90, 124–128
See application file for complete search history.

(56) References Cited

U.S. PATENT DOCUMENTS 3,324,558 A * 6/1967 Hart ..... 42/127
4,580,362 A * 4/1986 Stevens ..... 42/1.01
6,026,580 A 2/2000 LaRue
6,442,883 B1 * 9/2002 Waterman et al. ..... 42/124
7,370,449 B1 * 5/2008 Beckmann ..... 42/90
7,562,485 B2 * 7/2009 Newhall et al. ..... 42/127
8,201,355 B2 * 6/2012 Couture ..... F41G 11/003 42/124
8,336,247 B2 * 12/2012 Haering ..... F41G 11/003 42/111
8,393,105 B1 * 3/2013 Thummel ..... F41G 11/003 42/127
8,424,234 B2 * 4/2013 Carlson ..... F41G 11/001 42/125
8,567,105 B1 * 10/2013 Bobro ..... F41G 11/003 42/127
8,806,796 B1 * 8/2014 Clifton ..... 42/90
8,827,219 B2 * 9/2014 Kessler ..... F16M 11/048 248/187.1
2005/0246936 A1 * 11/2005 Kay ..... 42/146
2008/0155876 A1 * 7/2008 Matthews ..... F41G 11/003 42/124

(Continued)

OTHER PUBLICATIONS

Watercam, Steel vs. Aluminum picatinny rail, Oct. 28, 2009, AccurateShooter.com, p. 1.*

*Primary Examiner* — Stephen M Johnson
*Assistant Examiner* — Benjamin Gomberg
(74) *Attorney, Agent, or Firm* — Sutherland Asbill & Brennan LLP

(57) ABSTRACT

Embodiments of the invention can include systems and methods for associating an accessory with a firearm. According to one embodiment, an accessory having an accessory portion and an attachment portion can be provided. The attachment portion can allow the accessory to be mounted to at least a portion of a rail assembly of the firearm when the attachment portion is clamped to the portion of the rail assembly of the firearm. The attachment portion can include a clamp assembly comprising a clamped position and an unclamped position. The attachment portion can also include a lever assembly operable to move the clamp assembly between the clamped position and the unclamped position respectively. Moreover, the attachment portion can include a lever assembly housing for at least partially enclosing some or all of the lever assembly.

17 Claims, 7 Drawing Sheets

(56) References Cited

U.S. PATENT DOCUMENTS

2008/0168696 A1* 7/2008 Orne et al. ..... 42/90
2008/0216380 A1* 9/2008 Teetzel ..... F41G 11/003 42/127
2009/0038201 A1* 2/2009 Cheng et al. ..... 42/127
2011/0067287 A1* 3/2011 Collin ..... F41G 11/003 42/119
2011/0290968 A1* 12/2011 Maughan ..... F41G 11/004 248/231.51
2012/0198745 A1* 8/2012 Riley ..... F41C 27/00 42/90
2015/0068095 A1* 3/2015 Collin ..... F41G 11/003 42/90

* cited by examiner

SYSTEMS AND METHODS FOR ASSOCIATING AN ACCESSORY WITH A FIREARM

CROSS-REFERENCE TO RELATED APPLICATIONS

The present application is a non-provisional of and claims the benefit of U.S. Provisional Patent Application No. 61/428,981, filed Dec. 31, 2010, which is incorporated by reference in its entirety.

TECHNICAL FIELD

This disclosure generally relates to firearm accessories, and more particularly to systems and methods for associating an accessory with a firearm rail.

BACKGROUND OF THE DISCLOSURE

Firearms, such as M-16 and AR-15 rifles, are often used with accessories, such as scopes, sights, lasers, and grenade launchers. Typically, such accessories are associated with the firearm via a rail. The rail may include a number of mounting projections interleaved with a series of grooves, and these mounting projections and grooves may be employed to associate the accessory with the rail. Rails are known in the firearm industry and usually conform to certain standards defined by, for example, the U.S. government. For example, two common rails include the "Picatinny" rail and the "Weaver" rail, which both include interleaved mounting projections and grooves, but differ in dimension.

To associate an accessory with a rail, a device known as a "throw lever" may be used. A typical throw lever includes a clamping portion and a lever arm portion. The lever arm portion may be actuated to selectively clamp the throw lever to the rail, or to release the throw lever from the rail. For example, the throw lever may be clamped about one or more of the mounting projections.

In some cases, the lever arm portion of the throw lever may directly move the clamping portion into abutment against the rail. In other cases, the lever arm portion may indirectly act on the clamping portion via an intervening cam. The cam may transfer movement of the lever arm portion to the clamping portion, forcing the clamping portion into abutment against the rail.

Conventional throw levers may be problematic. For example, if the lever arm portion catches on or snags against an external object, the throw lever may open and may detach from the rail. For this reason, some firearm operators take the precaution of tethering the accessory to the firearm using a rope, so that the accessory is not lost if the throw lever opens.

Also, conventional throw levers may malfunction. For example, in cases in which the throw levers include a lever arm portion that directly moves the clamping portion, the clamping portion may be inclined to rub against and abrade the rail, which in time may impair the security of the connection. Such abrasion may be less problematic when the lever arm portion indirectly moves the clamping portion via an intervening cam, but in such cases the cam is typically exposed, such that dust and debris can become lodged about the cam and interfere with the operation of the throw lever.

Conventional throw levers also may not securely connect the accessory to the firearm. For example, some throw levers apply a clamping force to a relatively small portion of the rail, creating a connection that is relatively less secure than the connection that could be created by clamping to a relatively larger portion of the rail. This problem may be exacerbated by the relatively complex geometry of the mounting projection because many throw levers may be adapted to come in contact with only a small percentage of the mounting projection surface.

Conventional throw levers also may be difficult to operate. For example, attaching the throw lever to the rail may require two hands, leaving the firearm operator without a hand available to hold the firearm. Further, operating the throw lever may require an awkward hand motion. The throw lever may not be suited for use with accessories calibrated to a particular axial location along the rail, such as a scope. The throw lever may be able to slide along the rail when the lever arm portion is in an open position, which may require the firearm operator to manually position the throw lever along the rail at a selected axial position. For this reason, it may be difficult to reposition the throw lever in the same axial position on the rail after the throw lever has been removed, which is an issue with accessories such as scopes that are calibrated for a particular rail location.

SUMMARY OF THE DISCLOSURE

Embodiments of the invention can include systems and methods for associating an accessory with a firearm. In certain embodiments, an accessory having an accessory portion and an attachment portion can be provided. The attachment portion can allow the accessory to be mounted to at least a portion of a rail assembly of the firearm when the attachment portion is clamped to the portion of the rail assembly of the firearm. The attachment portion can include a clamp assembly comprising a clamped position and an unclamped position. The attachment portion can also include a lever assembly operable to move the clamp assembly between the clamped position and the unclamped position respectively. Moreover, the attachment portion can include a lever assembly housing for at least partially enclosing some or all of the lever assembly.

In other embodiments, a method for associating an accessory with a firearm can be provided. The method can include positioning a clamp assembly in an unclamped position with respect to the rail assembly. The method can also include engaging a lever assembly in mechanical communication with the clamp assembly from an open position to a closed position to clamp the clamp assembly to a portion of the rail assembly. The method can also include manipulating the clamp assembly to a clamped position and manipulating the lever assembly in the closed position.

In other embodiments, an accessory for a firearm can be provided. The accessory can include a clamp assembly comprising a clamped position and an unclamped position. The accessory can also include a lever assembly in mechanical communication with the clamp assembly, wherein the lever assembly is operable to move the clamp assembly between a clamped position and an unclamped position. The lever assembly can include a housing comprising an upper mounting platform and a lower mounting platform. The lever assembly can also include a lever partially disposed within the housing, wherein the upper mounting platform partially occludes the lever assembly while exposing at least part of the lever from above, and wherein the lower mounting platform occludes the lever assembly including the lever from below.

Other systems, devices, methods, and features of the disclosed systems, methods, and apparatuses will be apparent or will become apparent to one with skill in the art upon examination of the following figures and detailed description. All such additional systems, devices, methods, and features are intended to be included within the description and are intended to be protected by the accompanying claims.

BRIEF DESCRIPTION OF THE FIGURES

This disclosure may be better understood with reference to the following figures. Matching reference numerals designate corresponding parts throughout the figures, and components in the figures are not necessarily to scale.

DETAILED DESCRIPTION OF CERTAIN EMBODIMENTS

Described below are certain embodiments of a throw lever device that may facilitate associating an accessory with a firearm. In one embodiment, a throw lever device may be manipulated between a secured or clamped position and an unclamped or released position. In the secured or clamped position, the throw lever device may clamp or otherwise associate with a portion of the firearm to attach or otherwise associate an accessory with the firearm. In the unclamped or released position, the throw lever device may be removed from the firearm to disassociate the accessory from the firearm. In certain embodiments, reconfiguring the throw lever device between the secured or clamped and unclamped or released positions may be accomplished by a user, such as a firearm operator, with a single finger, such as a thumb, or one hand, which may permit the user to attach an accessory to the firearm while holding the firearm. Certain embodiments of a throw lever device may be lockable and may be disinclined from abrading the rail with repeated use, which may improve the security of the connection. In this manner, at least one technical solution provided by certain embodiments of a throw lever device can be the relatively quick clamping or unclamping of the throw lever device and associated accessory from a rail of a firearm using a single finger of a user's hand, such as the user's thumb.

In certain embodiments, a throw lever device may be associated with a rail of a firearm, such as a Picatinny-type rail or Weaver-type rail. Thus, an accessory associated with the throw lever device may be associated with the rail. For clarity, an example throw lever device mounted to a rail is illustrated without an accessory in FIGS. 1 and 2, although one would understand that one or more accessories may be associated with the throw lever device in a variety of manners. For example, an accessory may be coupled to or integrally formed on a mounting surface of the throw lever device. Suitable accessories can include, but are not limited to, scopes, sights, lasers, and grenade launchers.

Figure 1:
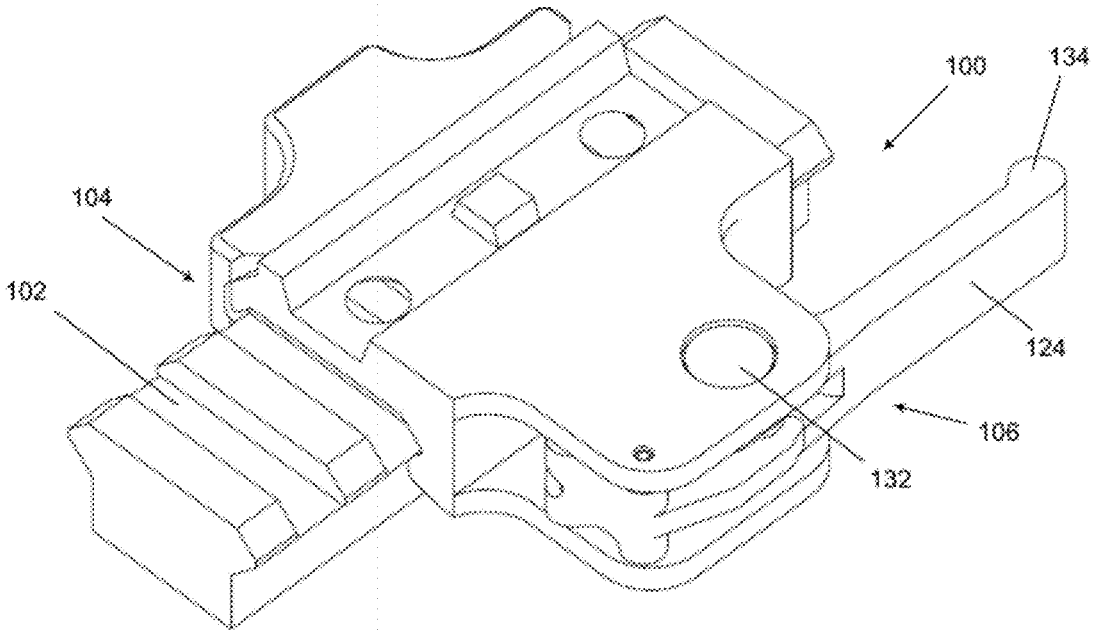
FIG. 1 is an upper perspective view of an example throw lever device mounted on a rail, in accordance with an embodiment of the invention.
Figure 2:
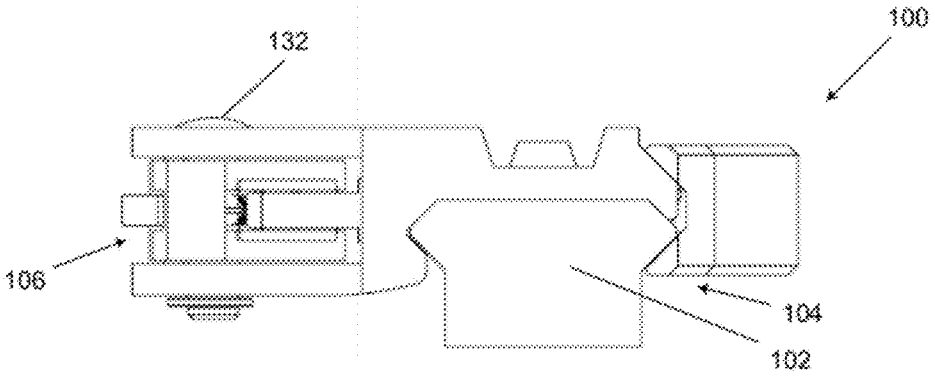
FIG. 2 is a rear view of the example throw lever device shown in FIG. 1 mounted on a rail, in accordance with an embodiment of the invention.

FIGS. 1 and 2 are views of an example throw lever device 100 mounted on a rail 102 in accordance with an embodiment of the invention. The throw lever device 100 shown in FIGS. 1 and 2 may be used to associate an accessory with a firearm. As shown, the throw lever device 100 generally includes a clamp assembly 104 and a lever assembly 106. The clamp assembly 104 can releasably secure, as desired, the throw lever device 100 to the rail 102. The lever assembly 106 can selectively secure and release, as desired, the clamp assembly 104. For example, the lever assembly 106 may move the clamp assembly 104 between a secured or clamped position, shown for instance in FIG. 3, and an unclamped or released position, shown for instance in FIG. 4.

Figure 3:
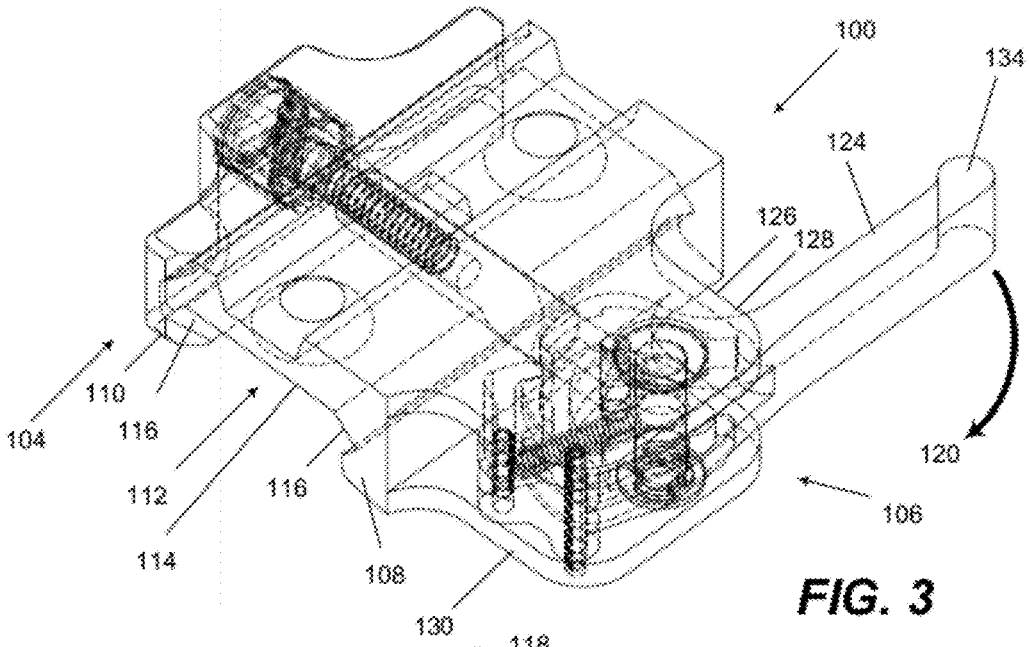
FIG. 3 is an upper perspective view of an example throw lever device not mounted to a rail, illustrating the internal components of the throw lever device when in a clamped position, in accordance with an embodiment of the invention.
Figure 4:
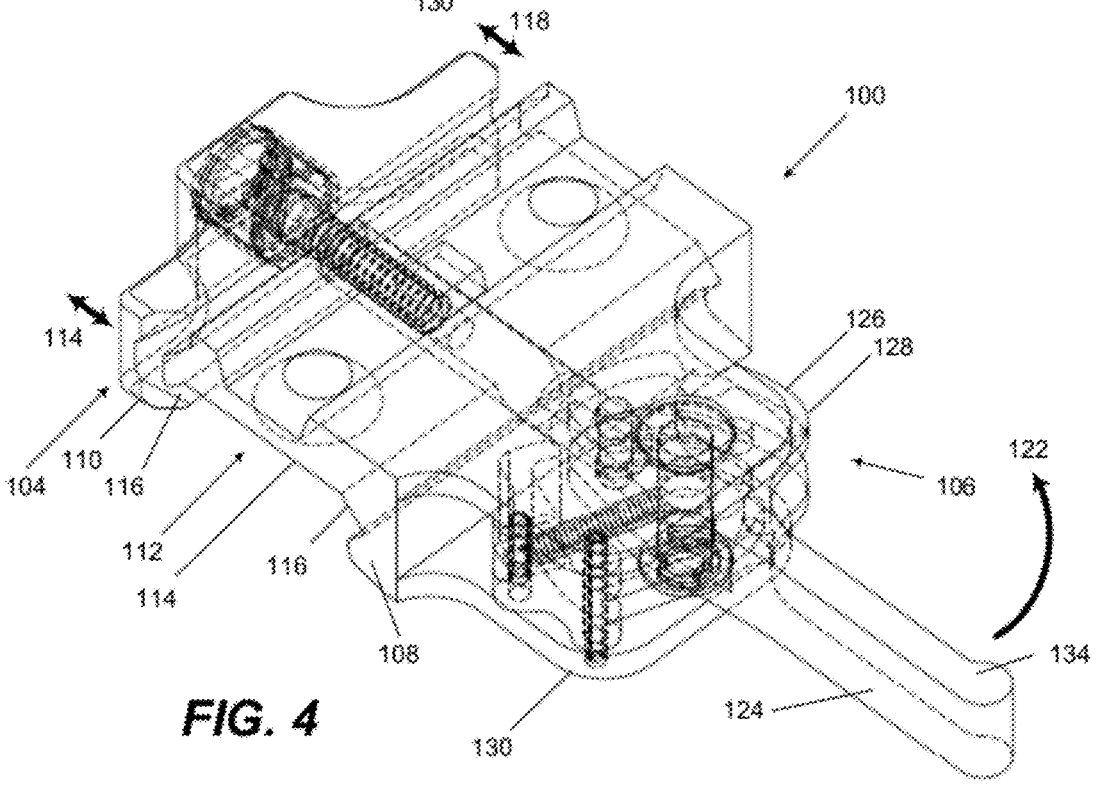
FIG. 4 is an upper perspective view of the throw lever device shown in FIG. 3, illustrating the internal components of the throw lever device when in a released position, in accordance with an embodiment of the invention.

More specifically, as depicted in FIGS. 3 and 4, the clamp assembly 104 may include a main body 108 and moveable clamp 110. The main body 108 may be associated with or integrally connected to a firearm accessory, such as a bayonet, a bipod, a vertical fore grip, a sight, an optical sight, a laser, a light, a grenade launcher, a scope, and/or an adapter, among others. The moveable clamp 110 may be manually manipulated, by a user, relative to the main body 108, between a secured or clamped position and an unclamped or released position.

By way of example only, the illustrated clamp assembly 104 can be configured or otherwise operable to clamp to a conventional Picatinny-type or Weaver-type rail. These rails have a series of longitudinally spaced mounting projections interleaved with a series of grooves. Each mounting projection has a profile that includes a relatively flat middle portion and two triangular protuberances positioned on opposite sides of the middle portion. A throw lever device, such as 100, can be shaped to mate with such a rail. For instance, the illustrated clamp assembly 104 can define a silhouette 112 that includes a relatively flat central portion 114 and two triangular-shaped indentations 116 positioned on opposite sides of the central portion 114. The silhouette 112 of the throw lever device 100 can match the relatively complex profile of the rail, such as rail 102, such that when the two are brought in close proximity to each other, a relatively secure connection can be created. In certain embodiments, one or more protuberances of the rail can become nestled in corresponding indentations of a clamp assembly, impeding vertical and lateral movement of the clamp assembly. In other embodiments, however, a clamp assembly may have other configurations depending on the configuration of the rail, which may vary.

FIGS. 3 and 4 are upper perspective views of the throw lever device 100, illustrating the clamp assembly 104 in the secured or clamped position in FIG. 3, and in the unclamped or released position in FIG. 4. When in an unclamped or released position, the moveable clamp 110 can be manipulated away from, towards, or otherwise relative to the main body 108 as shown by direction arrows 118, permitting the throw lever device 100 to be positioned relative to or removed from the rail 102. Likewise, when in a secured or clamped position, the moveable clamp 110 is adjacent to the main body 108, securing the throw lever device 100 and any associated accessory to the rail 102.

As depicted in FIGS. 3 and 4, the moveable clamp 110 can be actuated between the secured or clamped position and the unclamped or released position using the lever assembly 106. Direction arrows 120, 122 indicate the movements of an associated lever 124 used to manipulate the lever assembly 106. The lever assembly 106 can also include a housing 126, which protects the components of the lever assembly 106 from dust and debris, among others. The housing 126 can include an upper and lower mounting platform 128, 130. The mounting platforms 128, 130 can extend outwardly from the main body 108 opposite from the moveable clamp 110, although other configurations are possible.

Figure 6:
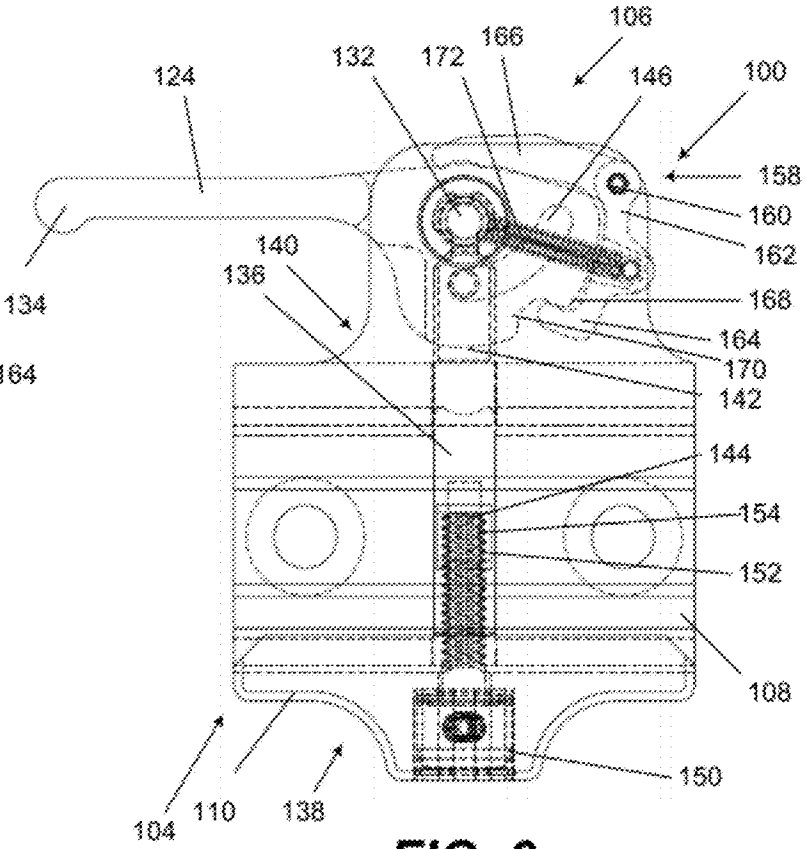
FIG. 6 is a top view of the example throw lever device shown in FIG. 3, illustrating the internal components of the throw lever device in a clamped position, in accordance with an embodiment of the invention.
Figure 5:
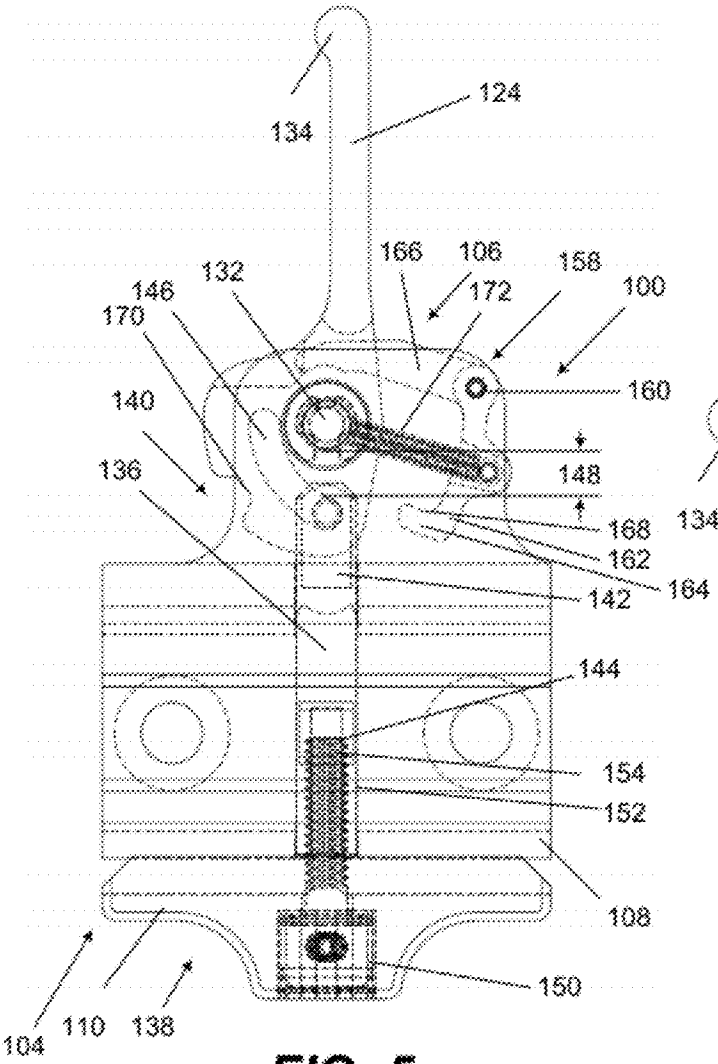
FIG. 5 is a top view of the example throw lever device shown in FIG. 4, illustrating the internal components of the throw lever device when in a released position, in accordance with an embodiment of the invention.

FIGS. 5 and 6 are corresponding top views of the throw lever device 100 shown in FIGS. 4 and 3. The lever assembly 106 can generally include the lever 124 and a pivot pin 132. The pivot pin 132 can extend between the upper and lower mounting platforms 128, 130. The lever 124 can be associated with the pivot pin 132 such that the lever 124 can rotate in the directions shown by 120, 122. Specifically, the lever 124 may be moved between a secured or clamped position, shown in FIGS. 3 and 6, and an unclamped or released position, shown in FIGS. 4 and 5. In the illustrated embodiment, rotating the lever 124 outward, away from the main body 108, moves the lever 124 from the secured or clamped position to the unclamped or released position, although other configurations are possible.

In certain embodiments, the lever 124 may include a finger pull 134 that is sized and shaped to cooperate with a finger of a user. For the finger pull 134 to receive the finger, the upper mounting platform 128 may be relatively smaller in size than the lower mounting platform 130. More specifically, the upper mounting platform 128 may be sized to occlude the internal components of the lever assembly 106 while exposing the finger pull 134 from above, while the lower mounting platform 130 may be sized to occlude both the internal components of the lever assembly 106 and the finger pull 134 from below. Thus, the internal components of the lever assembly 106 may be relatively enclosed, deflecting dust and debris that may interfere with the operation of the lever assembly 106. The finger pull 134 may be exposed from above and shielded from below, so that the finger pull 134 may be engaged from above to actuate the lever 124 but is protected from inadvertently catching on external elements from below.

With reference to FIGS. 5 and 6, the lever 124 may be located on an opposite side of the throw lever device 100 from the moveable clamp 110. So that the movement of the lever 124 can be transferred to the moveable clamp 110, a coupling rod 136 may extend between these components. The coupling rod 136 may be associated with the moveable clamp 110 on or adjacent to one end, known as the clamp end 138. The opposing end, or lever end 140 of the coupling rod 136 may be associated with the lever 124. On or adjacent to both ends, the coupling rod 136 may have at least one boss 142, 144. As shown in FIG. 5, the lever end boss 142 may be positioned in a cam track 146 formed through the lever 124, and as the lever 124 moves, the boss 142 may ride along the cam track 146. The cam track 146 may be shaped such that a distance 148 between the cam track 146 and the pivot pin 132 gradually changes as the lever 124 moves. Specifically, the distance 148 may gradually increase as the lever 124 moves from the closed position to the open position, as can be seen by comparing FIG. 5 and FIG. 6. The increase in the distance 148 may cause the boss 142 riding along the cam track 146 to move away from the pivot pin 132. Lateral movement of the boss 142 may be transferred through the coupling rod 136 to the moveable clamp 110, causing the clamp 110 to move outward into the released or unclamped position shown in FIG. 5. Further, the distance 148 may gradually decrease as the lever 124 moves from the open position to the closed position. The decrease in the distance 148 may cause the boss 142 riding along the cam track 146 to move closer to the pivot pin 132. The lateral movement of the boss 142 may be transferred to the coupling rod 136, which may pull the moveable clamp 110 into the clamped or closed position shown in FIG. 6. In this manner, a clamping force may be applied by the moveable clamp 110 in the clamped or closed position to secure the throw lever device 100 to a rail, such as rail 102 in FIGS. 1 and 2.

With reference to FIGS. 3-6, the cam track 146 and the boss 142 may be enclosed between the upper and lower mounting platforms 128, 130. Therefore, dust and debris may be impeded from interfering with the operation of the throw lever device 100. It should be noted that the boss 142 may be formed on the coupling rod 136 in a variety of manners. For example, the coupling rod 136 may be machined or cast with the boss 142 or the coupling rod 136 may receive a pin that forms the boss 142.

Figure 7:
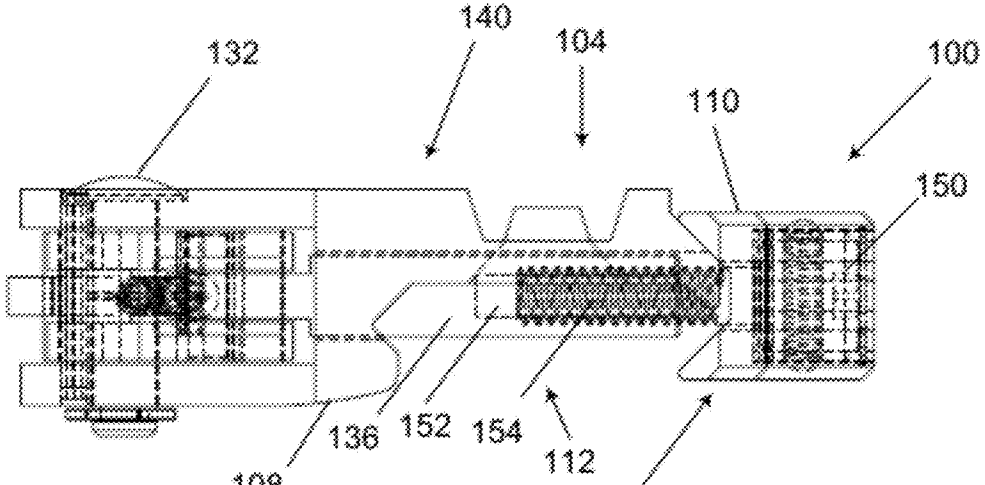
FIG. 7 is a rear view of the example throw lever device shown in FIG. 3, illustrating the internal components of the throw lever device in a clamped position, in accordance with an embodiment of the invention.

In certain embodiments, the moveable clamp 110 may be adjustably associated with the coupling rod 136, so that the clamping force facilitated by the clamp 110 can be tuned. For example, as shown in FIG. 7 the moveable clamp 110 may have a stepped opening 150 and the coupling rod 136 may have a threaded bore 152. A stepped screw 154, such as a socket head capped screw, may be inserted through the stepped opening 150 into the threaded bore 152. In one embodiment, the head of the stepped screw 154 may be exposed, so that the stepped screw 154 may be adjusted. In the embodiment shown in FIGS. 7 and 8, adjusting the stepped screw 154 may adjust the position of the moveable clamp 110 with reference to the coupling rod 136 and may be accomplished by rotating the clamp 110 with respect to the main body 108, or vice-versa, thus altering the subsequent clamping force. The clamping force may be decreased by loosening the screw 154, which increases a distance 156 between the moveable clamp 110 and an end of the coupling rod 136, shown in FIGS. 7 and 8. The clamping force may be increased by tightening the screw 154, which decreases the distance 156 between the moveable clamp 110 and the end of the coupling rod 136. It is noted that other configurations are possible. Further, the moveable clamp 110 may have a fixed position with reference to the coupling rod 136. For example, the coupling rod 136 may be glued to the moveable clamp 110 or may be integrally formed with the clamp 110, among others.

Figure 8:
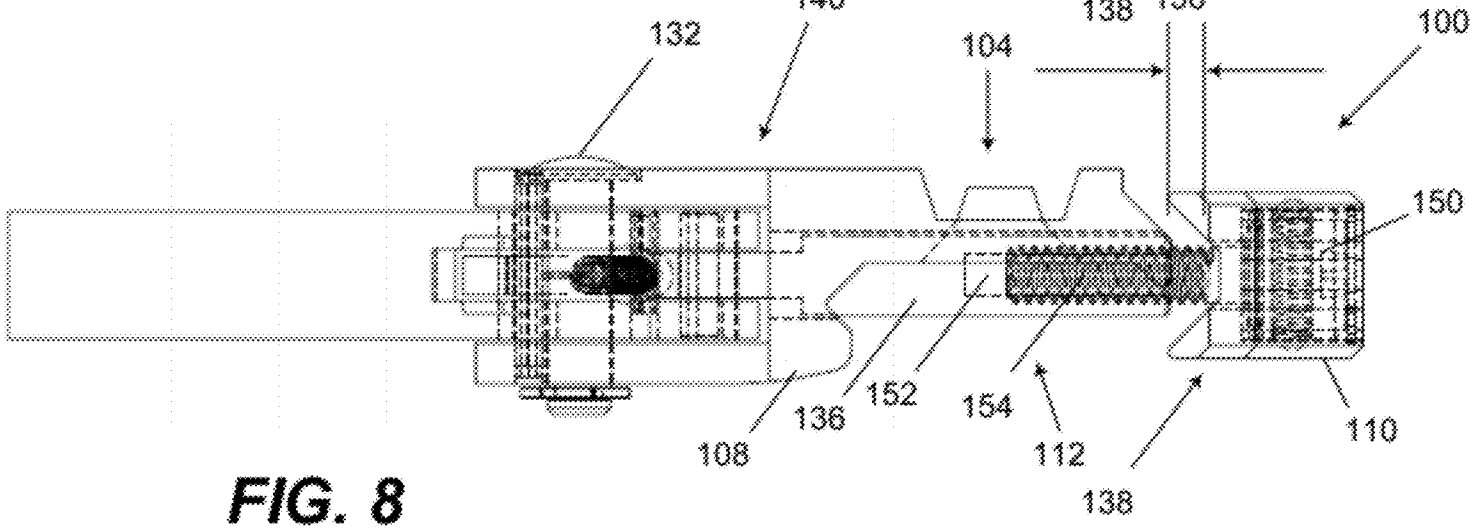
FIG. 8 is a rear view of the example throw lever device shown in FIG. 4, illustrating the internal components of the throw lever device in a released position, in accordance with an embodiment of the invention.
Figure 9:
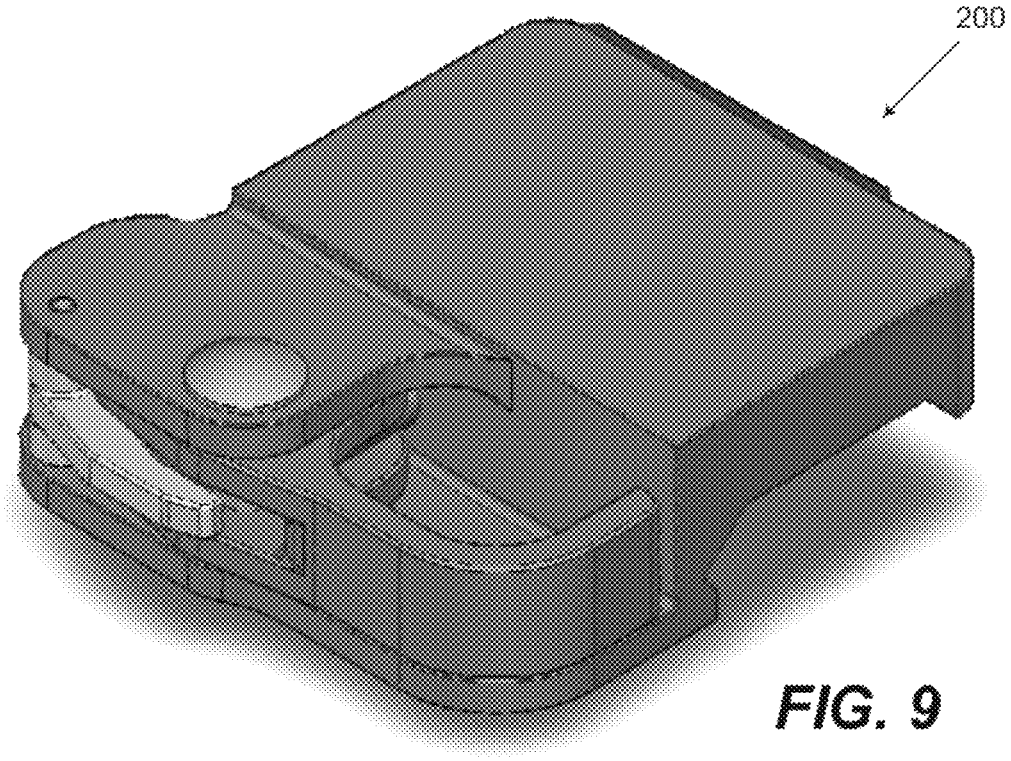
FIG. 9 is an upper perspective view of an example throw lever device not mounted to a rail, in accordance with an embodiment of the invention.
Figure 10:
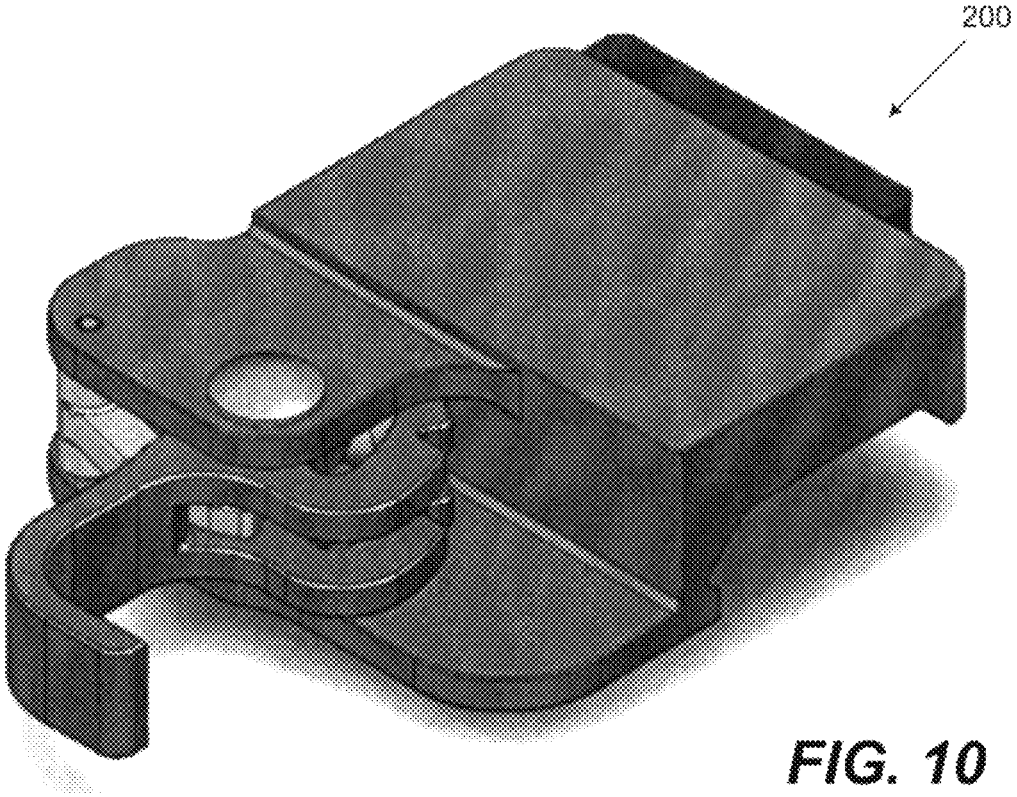
FIG. 10 is an upper perspective view of an example throw lever device not mounted to a rail, in accordance with an embodiment of the invention.
Figure 11:
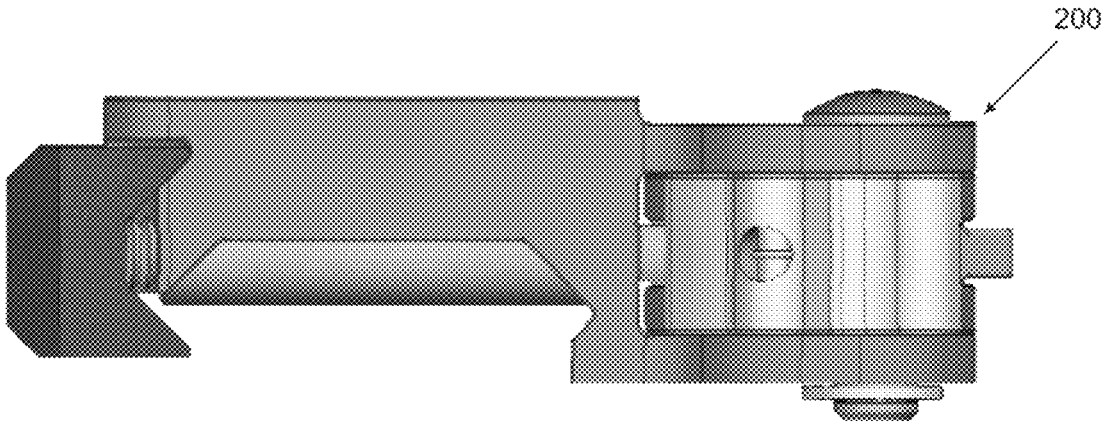
FIG. 11 is a front view of an example throw lever device not mounted to a rail, in accordance with an embodiment of the invention.
Figure 12:
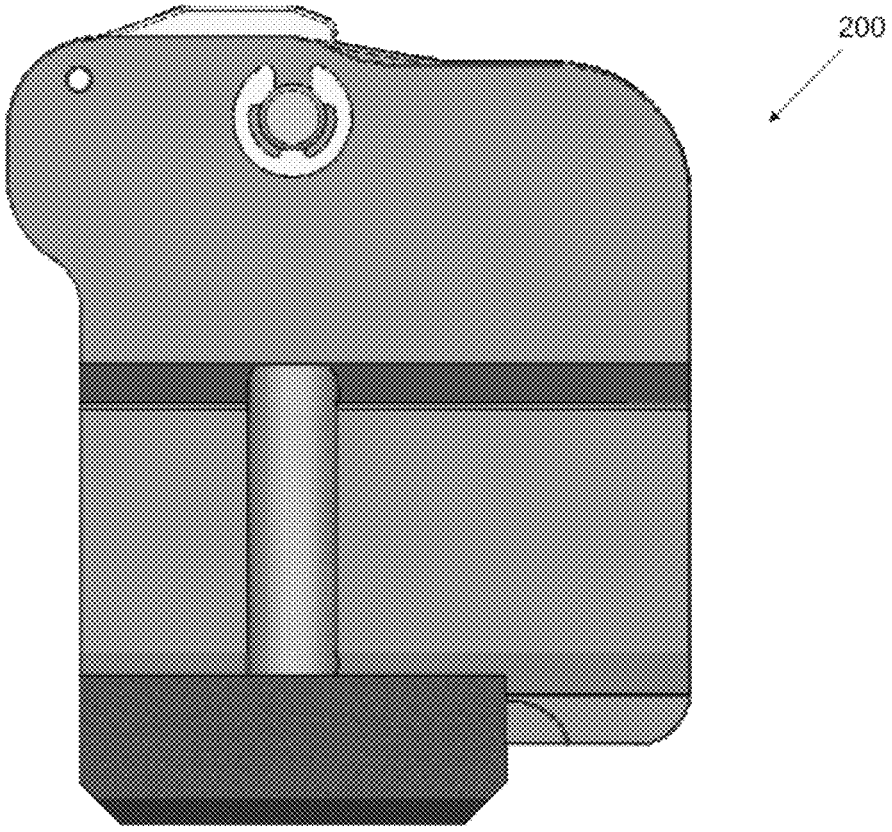
FIG. 12 is bottom view of an example throw lever device not mounted to a rail, in accordance with an embodiment of the invention.
Figure 13:
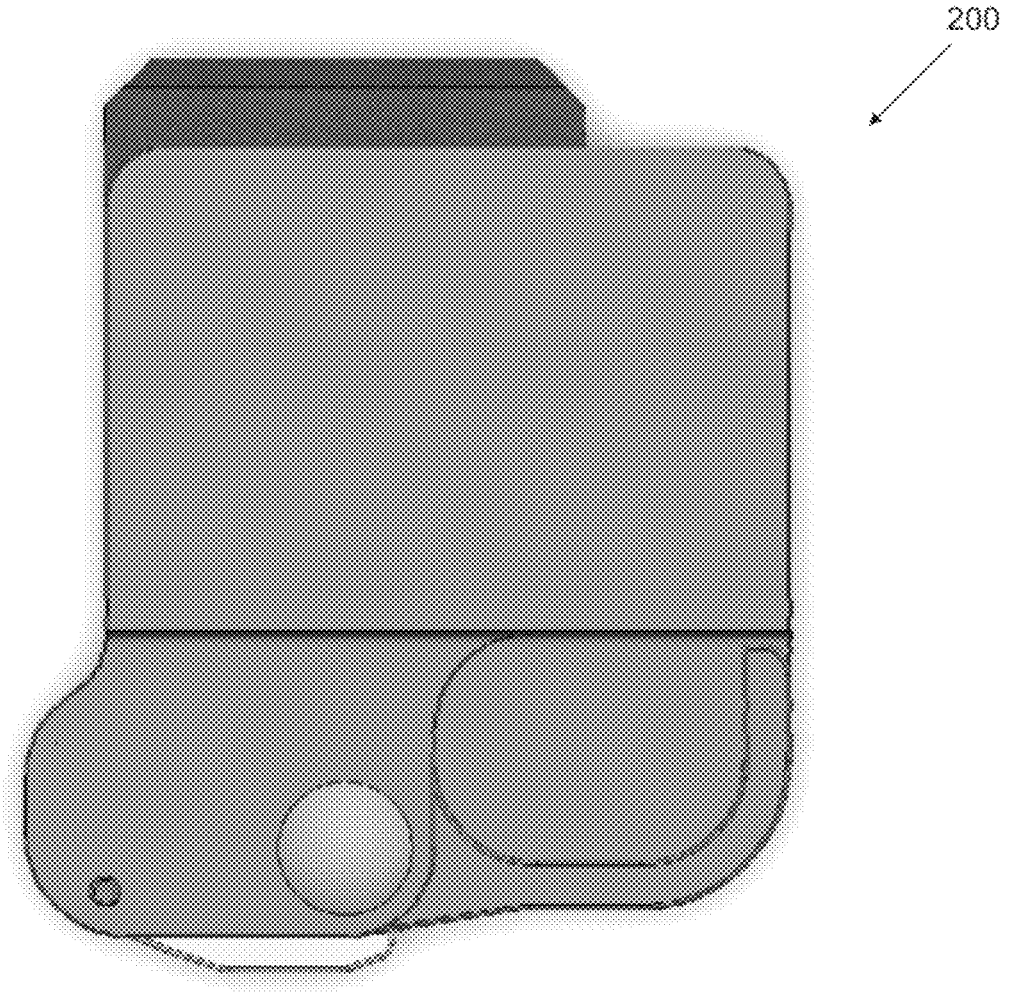
FIG. 13 is a top view of an example throw lever device not mounted to a rail, in accordance with an embodiment of the invention.

In certain embodiments, the throw lever device 100 may be configured to be repositioned on the rail in substantially the same place after the throw lever device 100 has been removed from the rail, such as rail 102. Therefore, a scope or other calibrated device may be repositioned at substantially the same location on the firearm. For this reason, the coupling rod 136 may protrude at least partially into the silhouette 112 of the clamping assembly 104, as shown in FIGS. 7 and 8. The coupling rod 136 may be sized to span the distance between two mounting projections on the rail, such as rail 102. Thus, when the throw lever device 100 is associated with the rail 102, the coupling rod 136 may become sandwiched in a groove between two mounting projections of the rail 102. Once the throw lever device 100 has been removed from the rail 102, the throw lever device 100 may be reattached in substantially the same position on the rail 102 by positioning the throw lever device 100 adjacent to the same two mounting projections and sandwiching the coupling rod 136 in the groove to identify the previous position of the throw lever device 100 on the rail 102.

In certain embodiments, the lever assembly 106 may also include a locking mechanism 158. The locking mechanism 158 may selectively limit movement of the lever assembly 106, impeding the ease of releasing the moveable clamp 110. As shown in FIGS. 5 and 6, the locking mechanism 158 may include an attachment post 160 and a latch arm 162. The attachment post 160 may extend between the upper and lower mounting platforms 128, 130, as depicted in FIGS. 3 and 4. The latch arm 162 may be positioned on the attachment post 160. The latch arm 162 may include a catch portion 164 and a release portion 166. In one embodiment, the release portion 166 may protrude outward from between the mounting platforms 128, 130 on a side of the throw lever device 100, so that the release portion 166 is accessible to the user. As shown in FIG. 6, the release portion 166 may be accessible to a user when the throw lever device 100 is in a clamped or closed position. The user can depress the release portion 166 with his or her finger or thumb, and then manipulate the lever 124 and lever assembly 106 towards an open or unclamped position. In any instance, the catch portion 164 may be enclosed between the mounting platforms 128, 130 so that the catch portion 164 is occluded from, for example, dust and debris. An associated foot 168 of the catch portion 164 may be sized and shaped to mate with an indent 170 formed in the lever 124. When the lever 124 is in the clamped or closed position, the position of the indent 170 corresponds to the location of the foot 168, so that the indent 170 can receive the foot 168, and thus maintain the location of the lever 124 in the clamped or closed position. A spring 172 or other biasing means may bias the catch portion 164 toward the lever 124. For example, the spring 172 may extend between the catch portion 164 and the pivot pin 132 to bias the catch portion 164 toward the pivot pin 132.

When the lever 124 is in the closed or clamped position as shown in FIG. 6, the lever 124 is typically impeded from moving. The foot 168 may align with the indent 170, and the spring 172 may bias the foot 168 into the indent 170. Typically, to move the lever 124 to the unclamped or released position as shown in FIG. 5, sufficient force may be applied to the lever 124 to cause the latch arm 162 to pivot about the attachment post 160, releasing the foot 168 from the indent 170. In one embodiment, to move the lever 124 to the unclamped or open position as shown in FIG. 5, a portion of the release portion 166 may be depressed, causing the latch arm 162 to pivot about the attachment post 160, releasing the foot 168 from the indent 170. In any instance, thereafter, the lever 124 may be rotated about the pivot pin 132 to move the clamp 110 to the unclamped or released position as shown in FIG. 5. Once the pressure on the release portion 166 is released, the spring 172 may bias the catch portion 164 toward the lever 124. However, the foot 168 may miss the indent 170 because the lever 124 has moved. When the lever 124 is again moved to the closed or clamped position, the indent 170 may become aligned with the foot 168. The spring 172 may bias the foot 168 into the indent 170, locking the lever 124 in the closed or clamped position. Thus, in the illustrated embodiment of FIG. 6, the lever 124 may be retained in the closed or clamped position until the locking mechanism 158 is affirmatively unlocked. However, the locking mechanism 158 may automatically lock when the lever 124 is moved into the closed or clamped position. It should be noted, however, that the illustrated locking mechanism 158 is merely one example of the type of locking mechanism 158 that may be employed in accordance with embodiments of the invention.

In certain embodiments, the clamp assembly 104 of the throw lever device 100 may be formed from the same material as the rail 102, so that wear between the throw lever device 100 and the rail 102 is reduced. Alternatively, the clamp assembly 104 may be formed from a material having similar properties to the rail, such as a similar hardness. Example materials may include steel, military specification coatings and materials, and composite materials, although any material or combinations of materials can be used.

FIGS. 9-13 illustrate various views of another example throw lever device 200 in accordance with an embodiment of the invention. The throw lever device 200 shown in FIGS. 9-13 operates similarly to the device 100 shown in FIGS. 1-8, though a slightly different configuration and orientation of component parts are illustrated.

Embodiments of the throw lever devices 100, 200 described above can be used to associate an accessory with a rail of a firearm. The accessory may be attached to or integrally connected with certain embodiments of the throw lever devices 100, 200, so that coupling the throw lever devices 100, 200 to, and releasing the throw lever devices 100, 200 from, the rail simultaneously associates or disassociates the accessory and the firearm. Example accessories include, but are not limited to, a scope, a sight, a laser, a grenade launcher, or a flashlight, among others.

Using certain embodiments of a throw lever device, such as 100, a user can relatively quickly manipulate the lever 124 and lever assembly 106 using a thumb or other finger of the user's hand. The throw lever device 100 shown in FIG. 1 is designed to facilitate placement of the user's thumb or other finger on the lever 124, such as adjacent to the finger pull 134, and/or release portion 166 to maximize the force applied by the user's thumb or other finger when the lever 124 and/or release portion 166 is manipulated by the user. In this manner, when needed, a user can quickly release the throw lever device 100 and associated accessory from a rail, such as rail 102, of a firearm. The throw lever device 200 of FIGS. 9-13 can be similarly operated.

Spatial terms, such as "upper" and "lower," and relative terms, such as "above" and "below," are used herein to facilitate understanding the disclosure. Such terms are not intended to be limiting. For example, a person of skill will understand that the rail may have mounting projections located on any side of the rail, and that certain embodiments of the throw lever devices 100, 200 may be used to associate an accessory with the rail in any orientation.

While particular embodiments of throw lever devices and associated methods for making and using the throw lever devices have been disclosed in detail in the foregoing description and figures for purposes of examples, those skilled in the art will understand that variations and modifications may be made without departing from the scope of the disclosure. All such variations and modifications are intended to be included within the scope of the disclosure, as protected by the following claims.

That which is claimed is:

1. An accessory for a firearm, the firearm comprising a rail assembly, the accessory comprising:

an accessory portion; and an attachment portion that mounts the accessory portion to at least a portion of the rail assembly of the firearm, the attachment portion comprising:

a clamp assembly comprising a moveable clamp and a stationary clamp, wherein the moveable clamp is operable for movement between a clamped position and an unclamped position;

a lever assembly including a lever operable to be manipulated by a user, wherein the lever is mounted in rotatable communication with a pivot pin, wherein the lever comprises a proximal end disposed adjacent to the pivot pin and a terminal tip end disposed distally of the pivot pin, wherein the lever is mechanically connected to the moveable clamp by way of a coupling rod having a boss at each end, wherein a lever end boss of the coupling rod is positioned within a cam track disposed within the proximal end of the lever to drive the movable clamp between the unclamped position and the clamped position as the lever assembly moves between a closed position and an open position, and wherein a clamping force associated with the clamped position is adjustable by way of an adjustable stepped screw inserted through a stepped opening in the movable clamp and at least partially positioned within an internal bore of the counting rod; and a lever assembly housing for enclosing a portion of the lever assembly, the lever assembly housing comprising:

an upper mounting platform, wherein the upper mounting platform is sized to occlude the proximal end of the lever while exposing the terminal tip end of the lever in the damped position; and a lower mounting platform, wherein the lower mounting platform extends flush with and occludes the terminal tip end of the lever in the clamped position, wherein the cam track and the lever end boss ace disposed between the upper mounting platform and the lower mounting platform.

2. The accessory of claim 1, wherein the clamp assembly further comprises:

a main body associated with the accessory portion.

3. The accessory of claim 2, wherein the lever is disposed on an opposite side of the main body from the moveable clamp.

4. The accessory of claim 3, wherein the clamping force of the clamp assembly is adjusted by increasing or decreasing a distance between the main body and the moveable clamp along the coupling rod.

5. The accessory of claim 3, wherein the coupling rod is configured to at least partially protrude between at least two mounting projections on the rail assembly of the firearm.

6. The accessory of claim 1, wherein the attachment portion comprises a silhouette that corresponds to a profile of the rail assembly of the firearm.

7. The accessory of claim 6, wherein the silhouette comprises at least one indentation for receiving at least one respective protuberance of the rail assembly of the firearm for impeding movement of the attachment portion.

8. The accessory of claim 1, further comprising a locking mechanism for locking the lever assembly comprising a locked position and an unlocked position that corresponds to the clamped position and the unclamped position of the clamp assembly.

9. The accessory of claim 8, wherein the locking mechanism is biased such that it automatically locks when the clamp assembly is in the clamped position.

10. The accessory of claim 8, wherein the locking mechanism requires a predefined force to move from the locked position to the unlocked position.

11. The accessory of claim 8, wherein the locking mechanism is configured to limit movement of the lever assembly, wherein the locking mechanism comprises:

an attachment post disposed between the upper mounting platform and the lower mounting platform;

a latch arm comprising a catch portion and a release portion, wherein the latch arm is pivotally attached to the attachment post; and an indent formed in the lever opposite the terminal tip end of the lever, wherein at least a portion of the catch portion is configured to mate with the indent.

12. The accessory of claim 11, wherein the pivot pin is disposed between the upper mounting platform and the lower mounting platform.

13. The accessory of claim 12, further comprising a spring attached to the pivot pin and the catch portion, wherein the spring is configured to bias the catch portion towards the lever.

14. The accessory of claim 11, wherein the release portion at least partially protrudes outward from between the upper mounting platform and the lower mounting platform in the clamped position.

15. The accessory of claim 11, wherein the catch portion is disposed between the upper mounting platform and the lower mounting platform in the clamped position and the unclamped position.

16. The accessory of claim 1, wherein the clamp assembly is formed from the same material as the rail assembly of the firearm.

17. The accessory of claim 1, wherein the rail assembly comprises at least one of the following: a Picatinny rail or a Weaver rail.

* * * * *